United States Patent [19]

Anderle et al.

[11] 3,994,744

[45] Nov. 30, 1976

[54] NO-SCRUB CLEANING METHOD

[75] Inventors: Robert C. Anderle; Robert F. Schwarz, both of Racine, Wis.

[73] Assignee: S. C. Johnson & Son, Inc., Racine, Wis.

[22] Filed: Oct. 1, 1974

[21] Appl. No.: 510,972

Related U.S. Application Data

[60] Continuation-in-part of Ser. No. 402,232, Oct. 1, 1973, abandoned, which is a division of Ser. No. 232,940, March 8, 1972, abandoned.

[52] U.S. Cl. ..... 134/4; 134/21; 252/90; 252/DIG. 2

[51] Int. Cl.[2] ..... B08B 7/00

[58] Field of Search ..... 134/4, 21; 252/89, 90, 252/135, DIG. 2, DIG. 3, DIG. 15, 523, 541; 260/29.6 H, 29.6 M, 29.6 MM

[56] References Cited

UNITED STATES PATENTS

| | | | |
|---|---|---|---|
| 3,574,124 | 4/1971 | Lyness et al. | 252/153 |
| 3,630,923 | 12/1971 | Simmons et al. | 252/99 |
| 3,716,488 | 2/1973 | Kolsky et al. | 252/155 |
| 3,723,323 | 3/1973 | Morgan et al. | 252/90 |
| 3,723,358 | 3/1973 | Morgan et al. | 252/546 |
| 3,835,071 | 9/1974 | Allen et al. | 252/545 |
| 3,901,727 | 8/1975 | Loudas | 134/4 |

*Primary Examiner*—S. Leon Bashore
*Assistant Examiner*—Marc L. Caroff

[57] ABSTRACT

Aqueous cleaning compositions having a minimum film-forming temperature of at least 30° C. and comprising a polymer having a glass transition temperature of at least 35° C. and a metal salt, form a tacky film after being applied to a soiled substrate. Soil adheres to the tacky film which, as a result of the drying of said composition, fractures to form a removable residue. Soil is removed from the substrate together with the residue. This method requires no scrubbing when cleaning soiled substrates with said aqueous cleaning compositions.

10 Claims, No Drawings

NO-SCRUB CLEANING METHOD

This application is a continuation-in-part of our co-pending application Ser. No. 402,232, filed Oct. 1, 1973, now abandoned which is a division of co-pending application Ser. No. 232,940, filed Mar. 8, 1972, now abandoned.

This invention relates to aqueous cleaning compositions. In one of its more specific aspects, this invention relates to aqueous cleaning compositions comprising a polymer and having specific characteristics as defined and described in the present application.

Although well-known as consumer products, many aqueous cleaning compositions require brushing, mopping, scouring, scrubbing or other manual action by the user while the composition is in a wet state to achieve effective cleaning results. As a consequence, our efforts have been directed toward the development of aqueous cleaning compositions which provide good cleaning results and require no manual action (except for application) by the user while the composition is in a wet state.

It is an object of this invention to provide novel aqueous cleaning compositions. Another object of this invention is to provide aqueous cleaning compositions which are useful for cleaning various soiled substrates (e.g., floor coverings such as floor tiles, rugs, and carpets; curtains; drapes; and wood panelling). Another object of this invention is to provide aqueous cleaning compositions which function with a minimum of manual action by the user, during the cleaning process. Another object of this invention is to provide aqueous cleaning compositions having specifically defined film properties comprising a polymer which has a specifically defined glass transition temperature. Another object of this invention is to provide aqueous cleaning compositions comprising a polymer and a metal and/or a builder. A further object of this invention is to provide a process for cleaning soiled substrates by use of the aqueous cleaning compositions as disclosed in the present application. A further object of this invention is to provide substrates which have been cleaned by the process and with the aqueous cleaning compositions of this application. Other objects of this invention will appear herein.

These and other objects are attained through the practice of this invention, at least one embodiment of which provides an aqueous cleaning composition having a minimum film-forming temperature of at least 30° C. and comprising from about 1 to about 50 percent, by weight, of a polymer having a glass transition temperature of at least 35° C. and 0.1 to 5 percent of a metal salt, said composition forming a tacky film which, as a result of the drying of said composition, fractures to form a removable residue.

Another embodiment of this invention provides a process for cleaning a soiled substrate, said process comprising the sequential steps of (1) applying to said substrate an aqueous cleaning composition having a minimum film-forming temperature of at least 30° C. and comprising from about 1 to about 50 percent, by weight, of a polymer having a glass transition temperature of at least 35° C. and 0.1 to 5 percent of a metal salt, (2) allowing said composition to form a tacky film to which soil adheres, (3) allowing said composition to dry whereby, as a result of said drying, said film fractures to form a removable residue, and (4) removing said residue and soil from said substrate.

Whenever used in this application, the term "fractures" will be understood to include crazing, cracking and/or breaking of the film into a removable residue.

The present invention provides aqueous cleaning compositions which enable the user to clean soiled substrates by applying the composition to the substrate and later removing a residue and soil by mechanical action (such as sweeping with a broom or vacuuming). Thus, the user is not required to exert any manual action between the time the composition is applied to the substrate and the time at which the residue and soil are removed. During drying on the substrate, the composition forms a tacky film to which soil on the substrate adheres. During continued drying of the composition, the film having the soil adhered thereto shrinks and fractures to form a removable residue. This residue is then removed from the substrate by mechanical action such as brooms or vacuum cleaners. Upon removal of the residue, the soil is also removed, thereby achieving effective cleaning of the substrate. Thus, the present invention provides aqueous cleaning compositions which require no scrubbing or scouring to obtain effective cleaning.

The compositions of this invention must have a minimum film-forming temperature of at least 30° C. and the ability to form a tacky film which, as a result of the drying of the composition, fractures before a self-supporting film is formed.

Although the above-referred to "tacky film" is continuous, it is not self-supporting. In other words, the tacky film cannot be removed intact from the substrate.

Polymers suitable for use in the aqueous cleaning compositions of this invention must have a glass transition temperature of at least 35° C. Such polymers may be of different chemical compositions, including acrylic polymers, polyesters, polycarbonates, polyamides and polyolefins.

As recited previously, the chemical composition of the polymer is not critical. However, especially good cleaning results may be achieved if the aqueous cleaning composition contains an acrylic polymer derived from ethylenically unsaturated monomers. These acrylic polymers may be prepared by methods well-known in the art and preferably are derived from a carboxylic acid monomer ("acid monomer") and a soft monomer and/or a hard monomer. A mixture of one or more acid monomers and one or more soft and/or hard monomers may also be employed to prepare these acrylic polymers. For example, a suitable polymer for the cleaning compositions of this invention may be derived from an acid monomer, two soft monomers and one hard monomer.

Soft monomers are those monomers which produce flexible homopolymers having a brittle point below about 20° C. Preferred soft monomers are vinyl acetate; the alkyl esters of acrylic acid wherein said alkyl group contains from 1–12 carbon atoms (such as methyl acrylate, ethyl acrylate, butyl acrylate, hexyl acrylate, 2-ethylhexyl acrylate and lauryl acrylate); and the higher alkyl esters of methacrylic acid wherein said higher alkyl group contains from 4–12 carbon atoms (such as butyl methacrylate, 2-ethylhexyl methacrylate and lauryl methacrylate). The preferred soft monomers are ethyl acrylate and butyl acrylate.

Suitable hard monomers which can be included in the acrylic polymer are the lower alkyl methacrylates wherein said lower alkyl group contains 1–3 carbon atoms (such as methyl methacrylate, ethyl methacrylate and isopropyl methacrylate); cycloalkyl acrylates and methacrylates wherein said cycloalkyl group contains 5–7 carbon atoms (such as cyclohexyl acrylate and cyclohexyl methacrylate); and hard vinyl monomers such as styrene and acrylonitrile. The preferred hard monomers are styrene and the lower alkyl methacrylates, particularly methyl methacrylate.

The acid monomers are monoethylenically unsaturated compounds having at least one, and preferably only one, carboxylic acid group. Examples of these monomers include acrylic, methacrylic, itaconic, maleic and crotonic acids; monoalkyl esters of itaconic and maleic acids wherein said alkyl group contains 1–8 carbon atoms (e.g., methyl, ethyl, butyl, hexyl, and octyl). The preferred acid monomers are acrylic and methacrylic acids.

Preferred acrylic polymers employed in the practice of this invention comprise from about 10 to about 50 percent, by weight, acid monomer, with the balance of the polymer comprising complementary amounts of hard and soft monomers. The especially preferred polymers contain 10 to about 50 percent acid monomer, about 10 to 90 percent soft monomer, and about 10 to 90 percent hard monomer. It will be understood that the precise chemical composition selected will depend upon the desired ultimate characteristics and the identity of the particular monomers employed.

Specific examples of preferred acrylic polymers are listed in Table I.

TABLE I

| Monomer | Weight Percent |
|---|---|
| styrene (S) | 100 |
| methacrylic acid (MAA) | 100 |
| methylmethacrylate (MMA) | 100 |
| vinyl chloride | 100 |
| MMA | 60 |
| MAA | 40 |
| MMA | 80 |
| MAA | 20 |
| MMA | 97 |
| MAA | 3 |
| S | 90 |
| MMA | 10 |
| MMA | 90 |
| S | 10 |
| MMA | 90 |
| isobornylmethacrylate (IBMA) | 10 |
| MMA | 50 |
| IBMA | 50 |
| t-butyl styrene | 85 |
| MAA | 15 |
| MMA | 90 |
| dimethylphosphatoethylmethacrylate | 10 |
| MMA | 90 |
| 2-nitro-2-methylpropyl methacrylate | 10 |
| MMA | 67 |
| butyl acrylate (BuA) | 30 |
| MAA | 3 |
| MMA | 85 |
| MAA | 5 |
| butylene dimethacrylate (BDM) | 10 |
| S | 59 |
| BuA | 25 |
| MAA | 16 |
| S | 30 |
| 2-ethylhexyl acrylate (2-EHA) | 30 |
| MAA | 40 |
| S | 30 |
| MMA | 30 |
| MAA | 40 |
| MMA | 50 |
| ethyl acrylate | 10 |
| MAA | 40 |
| S | 30 |
| BuA | 35 |
| MMA | 20 |
| MAA | 15 |
| MMA | 40 |
| BuA | 35 |
| MAA | 15 |

TABLE I-continued

| Monomer | Weight Percent |
|---|---|
| BDM | 10 |

The aqueous cleaning compositions of this invention do not require the presence of a surfactant (i.e., a detergent, soap, emulsifier) in order to achieve effective cleaning results. However, improved cleaning may be obtained if a small amount of surfactant is used. In some cases, the preparation of the polymers for these compositions will necessitate the use of a surfactant which may be carried over into these compositions. However, this surfactant should not be present in more than a minor amount since excessive surfactant levels have a plasticizing effect on the film.

The composition of the present invention contains from about 0.1 to about 5 percent of a metal salt to increase the brittleness of the film. Increased brittleness will promote fracturing which is necessary to form a removable residue and will produce a more easily removed residue. Suitable metal salts are the common and complex metal salts of aluminum, calcium, barium, chromium, manganese, iron, cobalt, nickel, copper, zinc, cadmium, lead, cerium, etc. It appears that the anions of these metals have little if any effect on the performance of the compositions of the present invention.

In addition, the metal salt may increase the effective glass transition temperature (Tg) of the polymer, especially if such polymer is derived at least in part from an acid monomer. In these instances, the requirement that the compositions of this invention comprise "a polymer having a glass transition temperature of at least 35° C." is satisfied by the use of a polymer-metal system having an effective Tg of at least 35° C. but where the polymer without metal may have a Tg of less than 35° C.

Preferred metal salts for use in this invention include the common and complex salts of zinc, cadmium, copper, nickel, cobalt, zirconium, chromium, manganese and calcium. Mixtures of these salts can also be used. It is preferred that the metal salt be added to the cleaning compositions of this invention as a complex metal salt, such as zinc ammonium carbonate, zinc ammonium citrate, zinc ammonium acetate, zinc ammonium formate, and other complex metal salts of the formula $M(NH_3)_n\ Y_2$ wherein M is selected from zinc, cadmium, copper, nickel, cobalt, zirconium, chromium, manganese, and calcium, and preferably $Zn^{+2}$, $Cd^{+2}$, $Co^{+2}$, or $Ni^{+2}$ and $n$ is the coordination number of M and Y is selected from carbonate, citrate, acetate, and formate and preferably carbonate, acetate and formate.

These aqueous cleaning compositions may also contain a builder which functions to enhance the cleaning properties. Suitable builders include salts, examples of which are tetrapotassium pyrophosphate, tetrasodium pyrophosphate, sodium citrate, sodium carbonate, sodium bicarbonate, sodium borate, and sodium metasilicate. In addition, suitable builders include polyelectrolytes (high molecular weight natural and synthetic polymers). Examples of polyelectrolytes are protein, gum arabic, polyethyleneimine, copolymers of polyvinyl methyl ether and maleic anhydride, polycarboxylates such as polyitaconic acid, and carboxymethyl cellulose.

A mixture of builders may be used. Especially preferred builders are tetrapotassium pyrophosphate, sodium citrate, and sodium carbonate. It is generally preferred that the compositions of this invention contain from about 0.1 to about 5 percent, by weight, of a builder.

When the aqueous cleaning compositions of this invention comprise a polymer, metal salt, and builder, a generally preferred ratio, by weight, of these components is 10 parts polymer:0.8 part metal salt:1 part builder.

In order to achieve particular functional or esthetic properties, these cleaning compositions may contain minor amounts of optional ingredients such as perfumes, dyes, pigments, bacteriocides, corrosion inhibitors, preservatives, flame retardants and stabilizers.

The compositions of this invention may be packaged in any suitable container, examples of which are flexible squeeze bottles, pump spray bottles, and aerosol containers. Such compositions may be pressurized and made available in this form by means of the addition of a suitable propellant. Any propellant which can self-pressurize the composition and serve as the means for dispensing such composition from the container is suitable. The preferred propellants are liquified normally gaseous hydrocarbons, liquified halogenated hydrocarbons and inert compressible gases. Preferred hydrocarbon propellants include the saturated aliphatic hydrocarbons such as propane, butane, isobutane, n-pentane and isopentane. Preferred halogenated hydrocarbons include dichlorodifluoroethane, dichlorotetrafluoroethane, trichlorotrifluoroethane and difluoroethane. Preferred inert compressible gases for use as propellants include nitrous oxide, nitrogen and carbon dioxide. Mixtures of two or more propellants can be used. Other usable propellants include the normal and branched hexanes and heptanes, monofluorotrichloromethane, difluoromonochloromethane, difluoromonochloroethane, difluorotetrachloroethane, pentafluoromonochloroethane and monofluorodichloromethane.

The propellant is desirably utilized in an amount sufficient to expel the entire contents of the container. In general, the propellant will be from about 5 percent to about 50 percent, preferably about 5 percent to about 15 percent, by weight, of the total composition. Pressurized forms of the compositions will generally be expelled from the container as foam. Non-pressurized compositions can be supplied as a concentrate to be diluted with water or as a fully constituted composition.

The results obtained by using the aqueous cleaning compositions of this invention may be interpreted through use of a Hunterlab Color Difference Meter (sold by Hunterlab Company of Fairfax, Virginia). This instrument measures substrate lightness, reported as L, on a scale of 0 to 100; a red-to-green scale of −100 to +100, reported as *a;* and a yellow-to-blue scale of −100 to +100, reported as *b*. The percent cleaning is reported as "total color regain" (TCR) and is calculated using the following formula $$\% \text{ TCR} = \left[ \frac{(L_c - L_s)^2 + (a_c - a_s)^2 + (b_c - b_s)^2}{(L_u - L_s)^2 + (a_u - a_s)^2 + (b_u - b_s)^2} \right]^{1/2} \times 100$$

wherein the subscripts *c*, *s* and *u* refer to the values of the cleaned, soiled and unsoiled substrates, respectively. By this method, the higher cleaning efficiencies are reported as higher values, up to a maximum value of 100. In other words, 100 percent cleaning efficiency is reported as a TCR of 100, and a 50 percent cleaning efficiency is reported as a TCR of 50.

The cleaning test to measure the effectiveness of our compositions proceeds as follows:

A. Using the above-described Meter, a value (u) is obtained for an unsoiled substrate such as a vinyl asbestos floor tile or a piece of carpeting.

B. The floor tile is artificially soiled by applying one of the following: a mixture of sifted 30 mesh vacuum cleaner dirt and water; a mixture of 30 mesh vacuum cleaner dirt, olive oil, hydrogenated vegetable oil and solvent; or a mixture of a liquid petrolatum, lubricating oil, hydrogenated vegetable oil, metallic brown oxide and solvent. The mixture is brushed uniformly on the substrate and allowed to dry for 24 hours.

The carpeting is artificially soiled by applying (e.g., brushing or ball milling) sifted 30 mesh vacuum cleaner dirt.

The floor tile and carpeting are naturally soiled by placing in a pattern of general foot traffic.

C. Using the Meter, a value (s) is obtained for the soiled substrate.

D. Next, an aqueous cleaning composition formulated according to this invention is applied to the soiled substrate. The composition is allowed to dry upon the substrate and then is removed by mechanical action, such as with a vacuum cleaner.

E. Using the Meter, a value (c) is obtained for the cleaned substrate.

F. The TCR is then calculated by using the above-described formula.

The removability of the residue produced by our composition can be ranked by use of the Meter and the following formula to determine "total color difference" (TCD):

$$\text{TCD} = (L_c - L_u)^2 + (a_c - a_u)^2 + (b_c - b_u)^2 \; {}^{1/2}$$

wherein the values L, *a*, *b*, *c* and *u* are as defined above. By this method, better removability is reported as a lower TCD.

The test to measure removability of our compositions proceeds as follows:

A. Using the Meter, a value (u) is obtained for an unsoiled piece of dark carpeting.

B. A composition of this invention is applied to the unsoiled carpeting, allowed to dry, and then removed by vacuuming.

C. Using the Meter, a value (c) is obtained for the cleaned carpeting.

D. The TCD is then calculated using the above formula.

The cleaning compositions of this invention are particularly useful in cleaning substrates which contain particulate soil, such as particles of ordinary dust and dirt. In addition, substrates containing oily and greasy soil can be cleaned with the compositions of this invention.

The aqueous cleaning compositions of this invention are particularly useful for cleaning carpets and rugs. These carpets may be comprised of various types of fibers, including acrylics sold under the trademarks "Verel", "Orlon", and "Acrilan"; polyesters sold under the trademarks "Kodel" and "Dacron"; nylon; wool; cotton; and blends of such fibers.

This invention will be further illustrated by the following examples of preferred embodiments. However, it will be understood that these examples are included for purposes of illustration and are not intended to limit the scope of this invention.

EXAMPLES 1–30

The following examples illustrate specific aqueous cleaning compositions which function as described in this application. These compositions are prepared in accordance with this invention by mixing the polymer with water, after which the metal salt (if used) is added as a complex metal salt solution. In these examples, the metal is zinc, which is added as a solution of zinc ammonium carbonate in water. Next, the builder (if used) is added to the aqueous mixture of polymer and metal. Finally, minor amounts of optional ingredients are added as indicated in Table II.

These specific compositions are tested for cleaning effectiveness using the Meter and procedure as described above.

The substrate is an acrylic carpet in Examples 1–16, a polyester carpet in Examples 17–22 and 27–30, and a nylon carpet in Examples 23–26.

The compositions are applied at the following rates (grams/square foot of substrate):

| Example | Rate |
|---|---|
| 1–4 and 26–30 | 60 |
| 5–10 | 20 |
| 11–20 | 60 |
| 21–22 | 15 |
| 23 | 230 |
| 24 | 120 |
| 25 | 30 |

In Examples 21–22, the composition also contains 10 percent, by weight, ethyl alcohol. Example 30 also contains 10 percent, by weight, of styrene/acrylic acid resin.

The balance of each of the thirty compositions is water.

TABLE II

| Example No. | Polymer and Weight Percent | Metal and Weight Percent | Builder and Weight Percent | TCD | TCR |
|---|---|---|---|---|---|
| 1 | 60 MMA<br>40 MAA<br>10 | zinc<br>.80 | sodium citrate<br>1 | 1.3 | 25.9 |
| 2 | same as Ex. 1 | zinc<br>.80 | tetrapotassium pyrophosphate (TKPP)<br>1 | 3.1 | 49.9 |
| 3 | 30 S<br>30 2-EHA<br>30 MAA<br>10 | zinc<br>.80 | sodium citrate<br>1 | 2.4 | 27.5 |
| 4 | 30 S<br>30 2-EHA<br>40 MAA<br>10 | zinc<br>.80 | TKPP<br>1 | 2.6 | 31.1 |
| 5 | same as Ex. 1 | zinc<br>.80 | TKPP<br>0 | 2.8 | 15.6 |
| 6 | same as Ex. 1 | zinc<br>.80 | TKPP<br>1 | 2.8 | 22.2 |
| 7 | same as Ex. 1 | zinc<br>.80 | TKPP<br>2 | 2.8 | 26.4 |
| 8 | 60 MMA<br>40 MAA<br>5 | zinc<br>.40 | TKPP<br>1 | 3.2 | 42 |
| 9 | same as Ex. 1 | zinc<br>.80 | TKPP<br>1 | 2.8 | 42 |
| 10 | 60 MMA<br>40 MAA<br>12.5 | zinc<br>1 | TKPP<br>1 | 3.5 | 55 |
| 11 | same as Ex. 1 | zinc<br>.80 | TKPP<br>1<br>sodium citrate<br>.9 | 2.7 | 32 |
| 12 | same as Ex. 1 | zinc<br>.80 | TKPP<br>1<br>sodium carbonate<br>.32 | 2.6 | 27 |
| 13 | same as Ex. 1 | zinc<br>.80 | Sodium citrate<br>1<br>sodium carbonate<br>.35 | 1.5 | 18 |
| 14 | same as Ex. 1 | zinc<br>.80 | TKPP<br>1 | 2.9 | 44 |
| 15 | same as Ex. 1 | zinc<br>.80 | TKPP<br>1 | 2.8 | 35 |
| 16 | same as Ex. 1 | zinc<br>.80 | TKPP<br>2 | 4.3 | 37 |
| 17 | 30 S<br>30 2-EHA<br>40 MAA<br>10 | — | — | 2.2 | 87 |
| 18 | same as Ex. 17 | — | TKPP<br>1 | 1.4 | 72 |
| 19 | same as Ex. 17 | zinc<br>.80 | — | 0.3 | 59 |
| 20 | same as Ex. 17 | zinc<br>.80 | TKPP<br>1 | 1.1 | 62 |
| 21 | same as Ex. 17 | — | TKPP<br>2 | — | 56 |
| 22 | same as Ex. 17 | — | TKPP<br>2 | — | 59 |

TABLE II-continued

| Example No. | Polymer and Weight Percent | Metal and Weight Percent | Builder and Weight Percent | TCD | TCR |
|---|---|---|---|---|---|
| 23 | 90 MMA<br>10 S<br>3.125 | — | — | (a) | 73 |
| 24 | 90 MMA<br>10 S<br>6.25 | — | — | (a) | 64 |
| 25 | 90 MMA<br>10 S<br>25 | — | — | (a) | 52 |
| 26 | 90 MMA<br>10 S<br>12.5 | — | — | (a) | 62 |
| 27 | 30 S<br>30 2-EHA<br>40 MAA<br>12.5 | — | TKPP<br>2 | (b) | 45 |
| 28 | same as Ex. 27 | — | sodium citrate<br>2 | (b) | 41 |
| 29 | 97 MMA<br>3 MAA | zinc<br>.80 | — | (b) | 54 |
| 30 | 100 MMA<br>12.5 | — | — | (b) | 72 |

(a) whitening present; TCD not measured but estimated at no more than 5–6.
(b) slight whitening present; TCD not measured but estimated at no more than 4–5.

EXAMPLE 31

The following aerosol aqueous cleaning composition which functions according to this invention is prepared as outlined in Examples 1–30:

| Component | | Weight Percent |
|---|---|---|
| Polymer: | 60 MMA<br>40 MAA | 10.0 |
| Metal salt: | Zinc ammonium carbonate | 0.8 |
| Builder: | TKPP | 1.0 |
| Propellant: | dichlorotetrafluoroethane | 6.0 |
| | isobutane | 3.0 |
| | propane | 1.0 |
| Ammonia | | 0.5 |
| Water | | 77.7 |
| | | 100.0 |

This composition is applied, under normal conditions of room temperature and humidity, to an acrylic carpet at a rate of 10 grams per square foot. Using the Meter, this composition has a TCR of 24 and a TCD of 1.1.

EXAMPLE 32

The chlorides of the metal ions listed in Table III were added in sufficient concentration to a 10 percent solution of 60 EMA/40 MAA polymers neutralized with $NH_4OH$ to produce a polymer carboxylate group:-metal ion concentration of 5.75:1. These systems were then placed on a smooth plastic surface to dry. The results are shown in Table III.

TABLE III

| Ion | Appearance |
|---|---|
| Control (no salt) | Continuous, no cracking |
| $Al^{+3}$ | Fractured |
| $Ca^{+2}$ | " |
| $Ba^{+2}$ | " |
| $Cr^{+3}$ | " |
| $Mn^{+2}$ | " |
| $Fe^{+3}$ | " |
| $Co^{+2}$ | " |
| $Ni^{+2}$ | " |
| $Cu^{+2}$ | " |
| $ZnO^{+2}$ | " |
| $Zn^{+2}$ | " |
| $Cd^{+2}$ | " |
| $Pb^{+2}$ | " |

TABLE III-continued

| Ion | Appearance |
|---|---|
| $Ce^{+3}$ | " |

Although this application specifically describes the use of these aqueous cleaning compositions in the general area of carpet care, such compositions may also be used to clean upholstery (such as fabric-covered chairs and sofas), automobiles, cookware (such as pots and pans), clothing (such as sweaters), and windows and other glass substrates. The compositions may also be used as all-purpose wax removers.

Although this invention has been described in detail with particular reference to preferred embodiments thereof, it will be understood that variations and modifications can be effected within the spirit and scope of this invention as described hereinabove and as defined in the appended claims.

We claim:

1. A process for cleaning a soiled substrate, said process consisting essentially of the sequential steps of (1) applying to said substrate an aqueous cleaning composition having a minimum film-forming temperature of at least 30° C. consisting essentially of from about 1 to about 50 percent, by weight, of a polymer having a glass transition temperature of at least 35° C. selected from the group consisting of co-polymers of at least one acid monomer and at least one soft monomer, co-polymers of at least one acid monomer and at least one hard monomer, and co-polymers of at least one acid monomer and a mixture of hard and soft monomers, from about 0.1 to about 5 percent by weight of a metal salt selected from salts of zinc, cadmium, copper, nickel, cobalt, zirconium, chromium, manganese, calcium and mixtures thereof and from 98.9 to 45 percent, by weight, water; (2) allowing said composition to form a tacky film to which soil adheres; (3) allowing said composition to dry whereby, as a result of said drying, said film fractures to form a removable residue; and (4) removing said residue and soil from said substrate.

2. The process of claim 1 wherein said salt is a complex metal salt of the formula $M(NH_3)_n Y_2$ wherein M is the metal ion $Zn^{++}$, $Cd^{++}$, $Cu^{++}$ or $Ni^{++}$, $n$ is the coordination number of M and Y is an anion selected from acetate, formate and carbonate, and mixtures thereof.

3. The process of claim 2 wherein M is $Zn^{++}$ and Y is carbonate.

4. The process of claim 1 wherein said polymer comprises 60 percent, by weight, methylmethacrylate and 40 percent, by weight, methacrylic acid.

5. The process of claim 1 wherein said composition contains from about 0.1 to about 5 percent, by weight, of a builder.

6. The process of claim 5 wherein said builder is tetrapotassium pyrophosphate.

7. The process of claim 1 wherein said composition is packed within a pressurized aerosol container and contains a propellant selected from the group consisting of liquified normally gaseous hydrocarbons, liquified halogenated hydrocarbons, and inert compressible gases.

8. The process of claim 7 wherein said propellant is selected from propane, butane, isobutane, n-pentane, isopentane, dichlorodifluoroethane, dichlorotetrachloroethane, trichlorotrifluoroethane, difluoroethane, nitrous oxide, nitrogen, carbon and mixtures thereof.

9. The process of claim 1 wherein said cleaning composition contains from about 3 to about 35 percent, by weight of said polymer.

10. The process of claim 1 wherein said salt is selected from chlorides of zinc, cadmium, copper, nickel, cobalt, zirconium, chromium, manganese, calcium and mixtures thereof.

* * * * *